US007972152B1

(12) United States Patent
Wu

(10) Patent No.: US 7,972,152 B1
(45) Date of Patent: Jul. 5, 2011

(54) POWER SOCKET DEVICE HAVING ROTATION-OPERATED SWITCH FUNCTION

(75) Inventor: Jui-hsiung Wu, Taipei (TW)

(73) Assignees: Well Shin Technology Co., Ltd., Taipei (TW); Dongguan Well Shin Electronic Products Co., Ltd., Dongguan, Guangdong (CN)

( * ) Notice: Subject to any disclaimer, the term of this patent is extended or adjusted under 35 U.S.C. 154(b) by 0 days.

(21) Appl. No.: 12/958,342

(22) Filed: Dec. 1, 2010

(51) Int. Cl.
*H01R 13/44* (2006.01)
*H01R 13/60* (2006.01)

(52) U.S. Cl. ..... 439/131; 439/172

(58) Field of Classification Search ..... 439/131, 439/171–174
See application file for complete search history.

(56) References Cited

U.S. PATENT DOCUMENTS 5,613,863 A * 3/1997 Klaus et al. ..... 439/131
6,059,584 A * 5/2000 Mareno ..... 439/131

* cited by examiner

*Primary Examiner* — Javaid Nasri
(74) *Attorney, Agent, or Firm* — Cheng-Ju Chiang

(57) ABSTRACT

A power socket device having a rotation-operated switch function is disclosed, and has a housing, a first conductive frame, a second conductive frame and a plurality of socket units. The housing has recesses, each of which is installed with a socket plate having terminal slots. The first and second conductive frames are mounted in the housing. The socket unit is rotatably installed in the recess and corresponding to the socket plate. The socket unit has a socket housing, an insulating body and terminals. Each of the terminals has one end passing through one of the terminal slots to be in contact with or separated from the first and second conductive frame. Thus, the socket units can be rotated to switch on or off without unplugging the power socket device, so that the operation of the power socket device is relatively simple and labor-saving.

5 Claims, 5 Drawing Sheets

POWER SOCKET DEVICE HAVING ROTATION-OPERATED SWITCH FUNCTION

FIELD OF THE INVENTION

The present invention relates to a power socket device having a switch function, and more particularly to a power socket device having a rotation-operated switch function.

BACKGROUND OF THE INVENTION

Presently, a power socket device is widely applied to the house and the workplace, wherein the power socket device has a plug to be connected to an external power for supplying an electric power.

A traditional switchable power socket device comprises a cover, a plurality of socket units mounted on the cover, and a main switch mounted on the cover. Alternatively, the power socket device also can comprise a plurality of switches, each of which is corresponding to each of the socket units. The main switch or one of the switches can be pressed to control to connect or disconnect a plug of an electric device plugged in one of the socket unit, in order to save the electric power. When the plug is plugged in the power socket device, the plug is in contact with electrodes of the socket unit to form an electrical connection therebetween. When the power socket device is no longer used after work, the plug must be unplugged from the socket unit, or one of the switches on the power socket device should be switched off, for the purpose of saving the power.

However, in the case that the traditional switchable power socket device has the main switch, other of the socket units can not be disconnected with the power when one of the socket units is used, so that the purpose of saving the power can not be carried out. On the other hand, in the case that the traditional switchable power socket device has the plurality of switches corresponding to each of the socket units, respectively, the cost of the power socket device is relatively high. Besides, although the plugs can be unplugged to save the power, the unplugging operation is inconvenient and the socket units may be accumulated with dust, resulting in lower conductivity or other security problems.

SUMMARY OF THE INVENTION

A primary object of the present invention is to provide a power socket device having a rotation-operated switch function, which has a relatively simple structure being convenient to be controlled and easy to carry out the purpose of saving the power, and thus can overcome the disadvantages existing in the conventional technologies, as described above.

To achieve the above object, the present invention provides a power socket device having a rotation-operated switch function, wherein the power socket device comprises a housing, a first conductive frame, a second conductive frame and a plurality of socket units. The housing is formed with a plurality of recesses, each of which is installed with a socket plate having a pair of terminal slots. The first and second conductive frames are mounted in the housing. Each of the socket units is rotatably installed in each of the recesses and corresponding to one of the socket plates. The socket unit has a socket housing, an insulating body installed in the socket housing and a pair of terminals installed in the insulating body. Each of the terminals has one end passing through one of the terminals slots to be in contact with or separated from one of the first and second conductive frames, respectively.

As described above, the power socket device of the present invention has a rotation-operated switch function, so that each of the socket units can be rotated to switch on or off without unplugging the power socket device, so that the operation of the power socket device is relatively simple and labor-saving.

DETAILED DESCRIPTION OF THE PREFERRED EMBODIMENTS

The structure and the technical means adopted by the present invention to achieve the above and other objects can be best understood by referring to the following detailed description of the preferred embodiments and the accompanying drawings. Furthermore, directional terms described by the present invention, such as upper, lower, front, back, left, right, inner, outer, side and etc., are only directions by referring to the accompanying drawings, and thus the used directional terms are used to describe and understand the present invention, but the present invention is not limited thereto.

Figure 1:
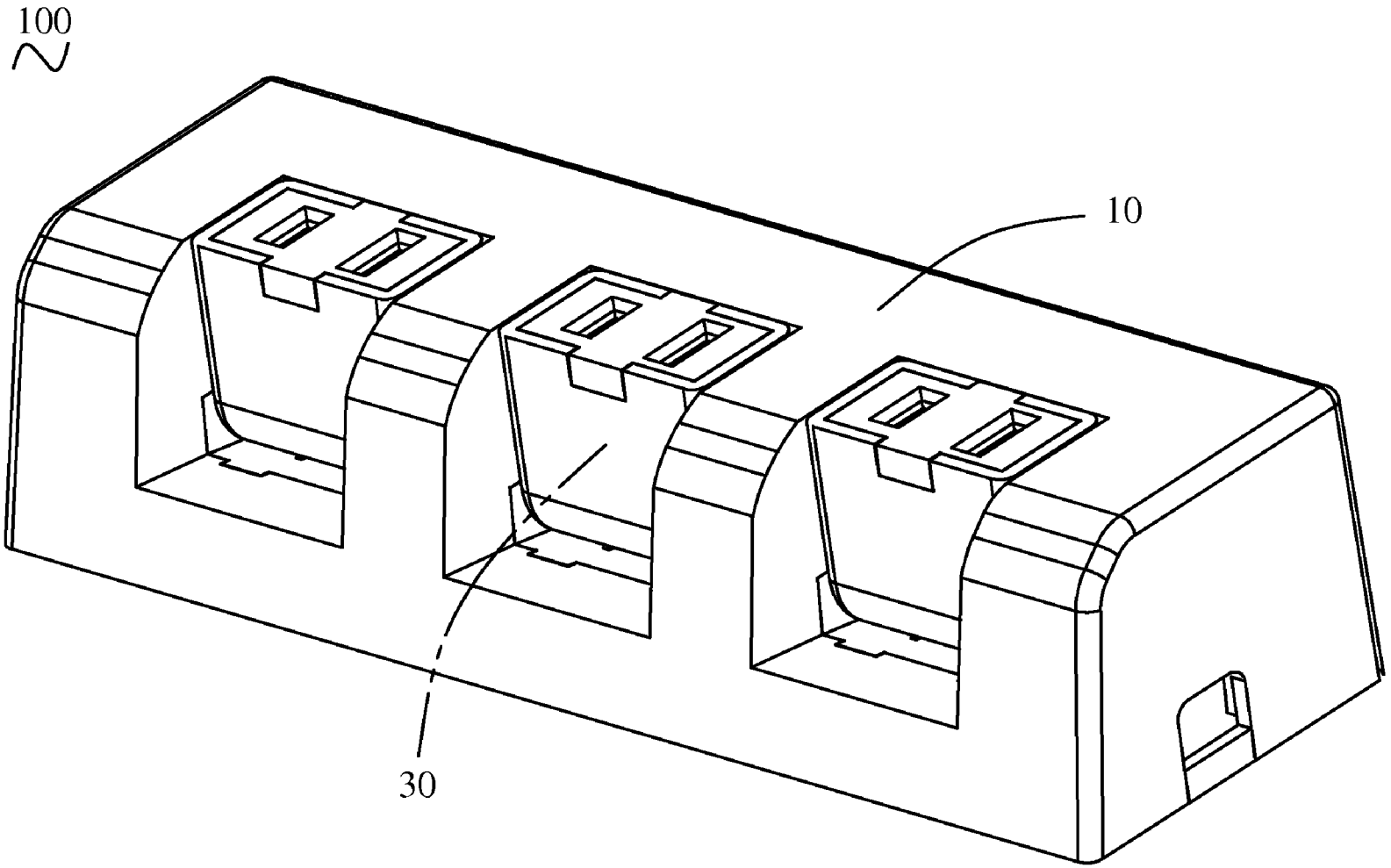
FIG. 1 is an assembled perspective view of a power socket device having a rotation-operated switch function according to a preferred embodiment of the present invention.
Figure 2:
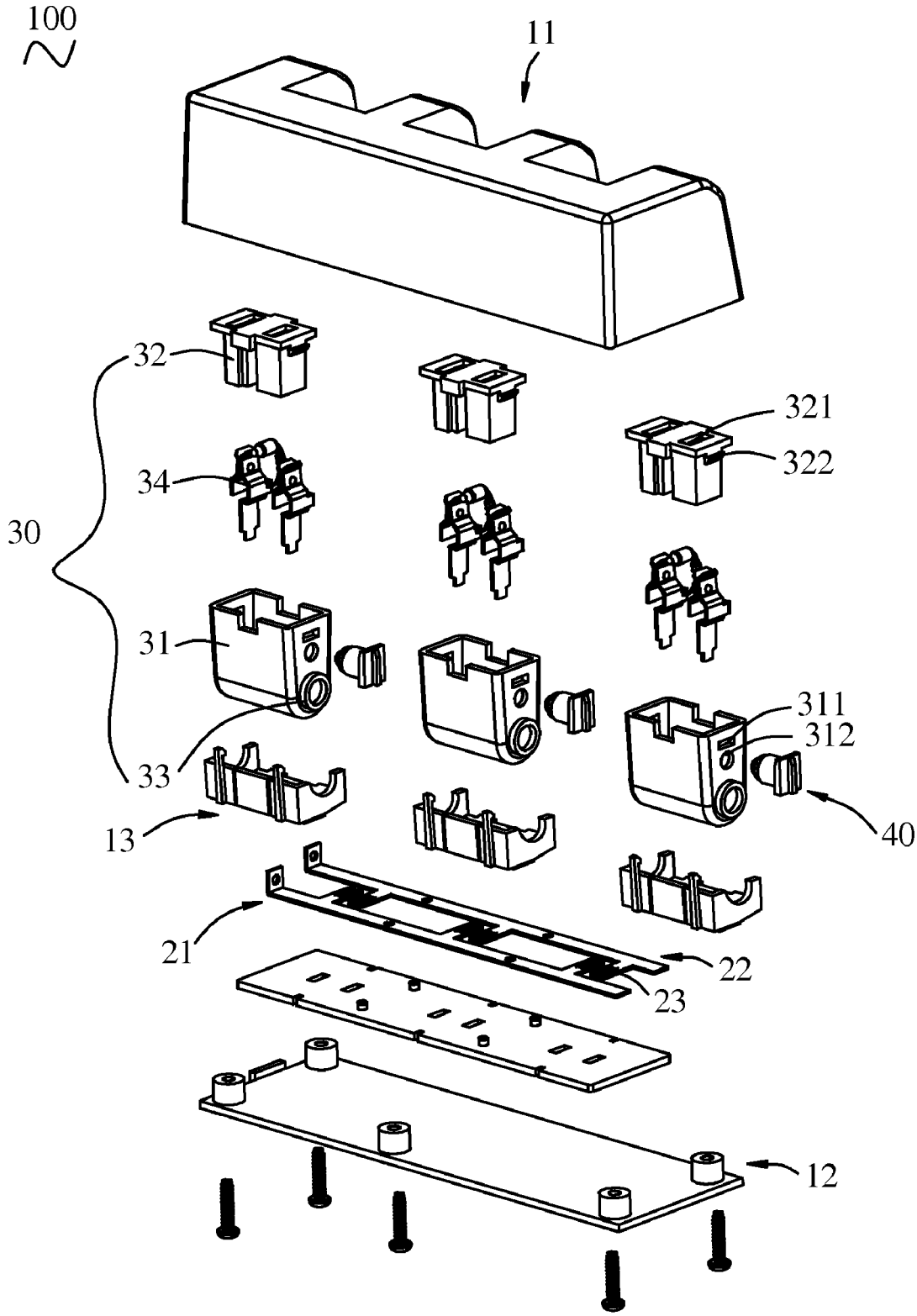
FIG. 2 is an exploded perspective view of the power socket device having the rotation-operated switch function, as shown in FIG. 1.

Referring to FIGS. 1 and 2, a power socket device 100 having a rotation-operated switch function according to a preferred embodiment of the present invention is illustrated. As shown, the power socket device 100 comprises a housing 10, a first conductive frame 21, a second conductive frame 22, a plurality of socket units 30 and a plurality of positioning members 40.

Figure 3:
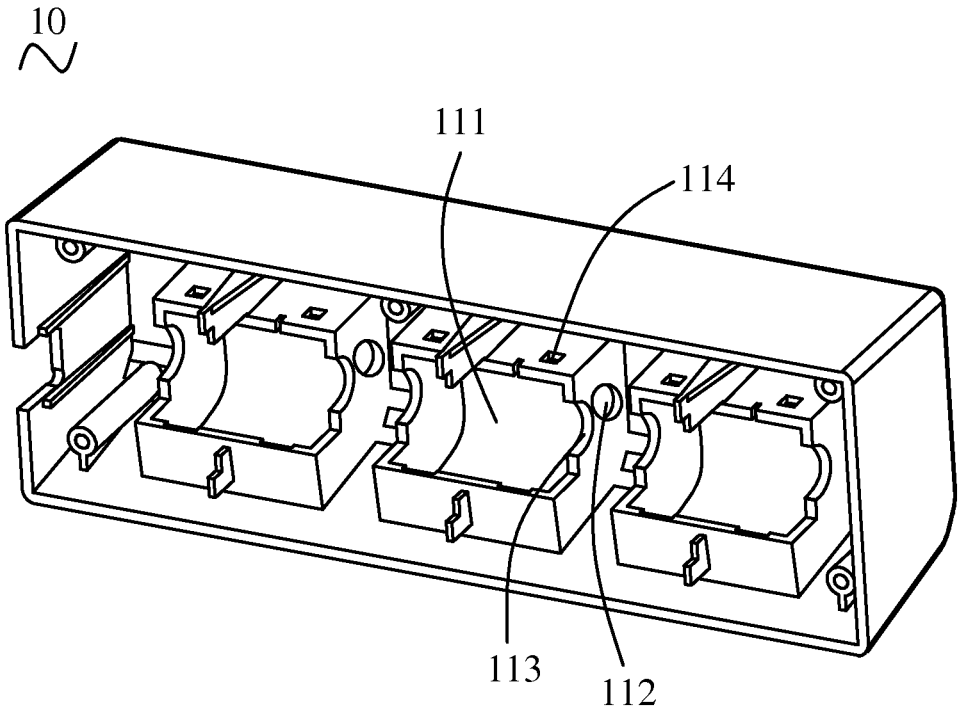
FIG. 3 is a perspective view of an upper housing of the power socket device having the rotation-operated switch function, as shown in FIG. 1.
Figure 5:
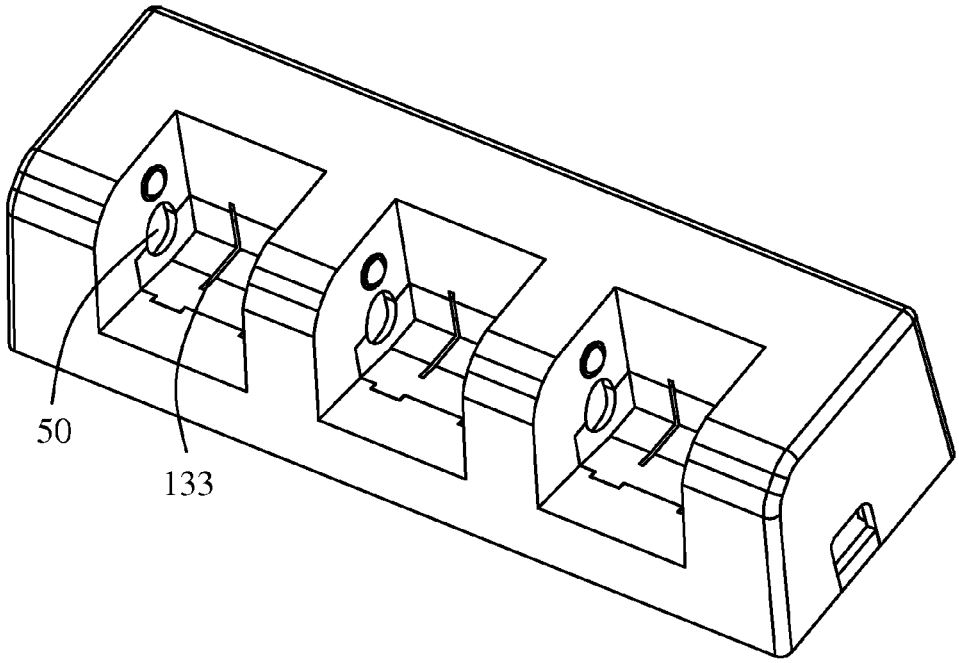
FIG. 5 is an assembled perspective view of the upper housing and a lower housing of the power socket device having the rotation-operated switch function, as shown in FIG. 1.

Referring to FIGS. 2, 3 and 5, the housing 10 comprises an upper housing 11, a lower housing 12 and a plurality of socket plates 13. The upper housing 11 has a plurality of recesses 111 on the top portion thereof, a plurality of positioning holes 112, each of which is formed on one side wall of one of the recesses 111, a plurality of upper indentations 113, formed on two side walls of each of the recesses 111 and under one corresponding positioning hole 112, and a pair of engagement holes 114 formed on a rear wall of each of the recesses 111. The bottom of each of the recesses 111 is opened through the inner space of the upper housing 11. The lower housing 12 is plate-like.

Figure 7:
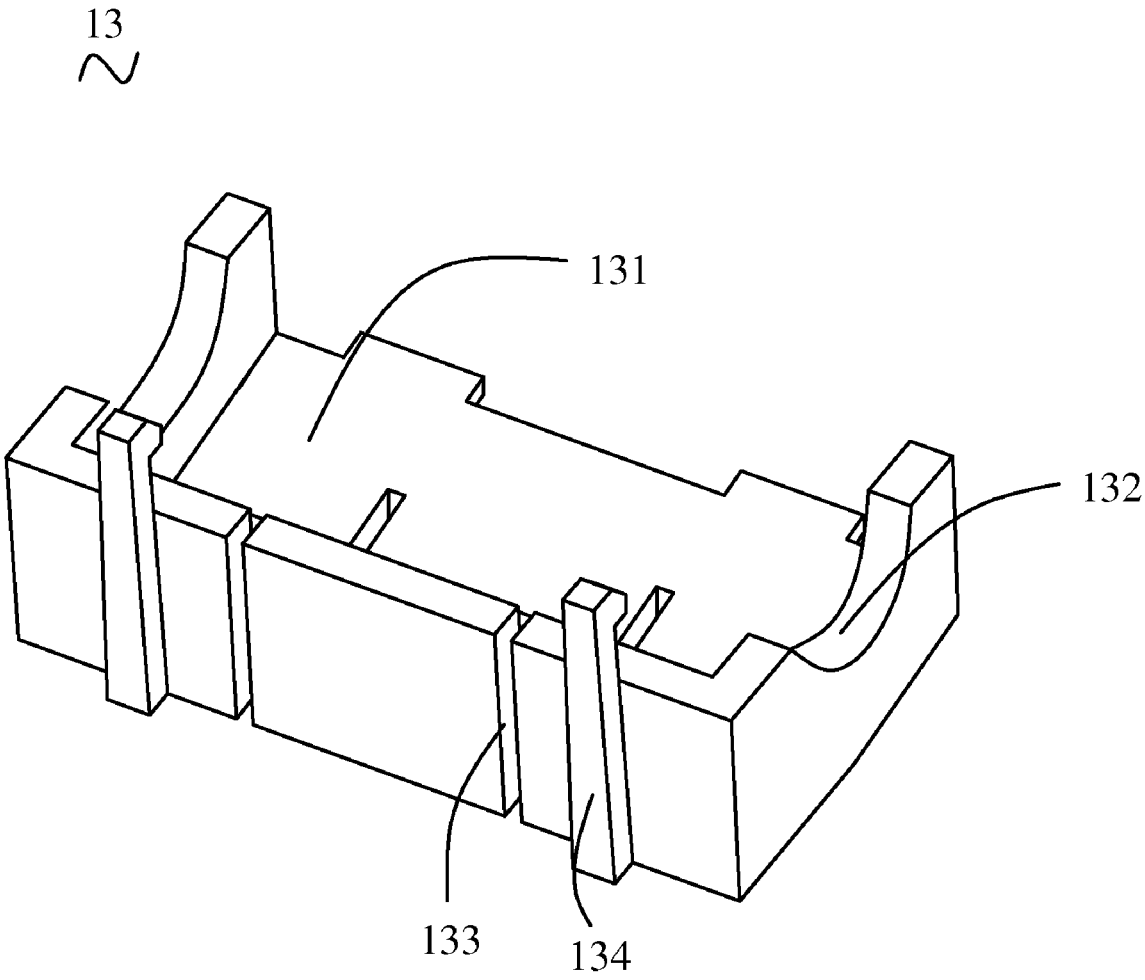
FIG. 7 is a perspective view of a socket plate of the power socket device having the rotation-operated switch function, as shown in FIG. 1.

Referring to FIGS. 2 and 7, each of the socket plates 13 is mounted on the bottom of one of the recesses 111 of the housing 10, wherein each socket plate 13 has a lower wall, a rear wall and two side walls. The lower wall, the rear wall and the two side walls define a receiving space 131 opened in front and top of the socket plate 13. Each of the two side walls of each socket plate 13 is formed with a lower indentation 132, wherein the lower indentation 132 and its corresponding upper indentation 113 construct a rotation hole 50, as shown in FIG. 5. The lower wall of each socket plate 13 is formed with a pair of terminal slots 133 which extend to the rear wall of the socket plate 13. An outer surface of the rear wall of each socket plate 13 is formed with a pair of positioning rods 134 projecting upward therefrom and located on outer sides of the terminal slots 133, wherein the distal end of each of the positioning rods 134 is positioned in one of the engagement holes 114 of the housing 10, so that each socket plate 13 can be mounted with the housing 10 and corresponding to one recess 111.

Referring still to FIG. 2, the first conductive frame 21 and the second conductive frame 22 are mounted on the lower housing 12, with a pair of elastic terminals 23 provided corresponding to each of the socket units 30.

Each of the socket units 30 is rotatably installed in one of the recesses 111 and comprises a socket housing 31, an insulating body 32 installed in the socket housing 31, a rotatable portion 33 and a pair of terminals 34 installed in the insulating body 32. A lower portion of the socket housing 31 is rotatably received in the receiving space 131. The socket housing 31 has a lower wall having a curved cross-sectional shape, while each edge of the lower wall is extended upward to form a front wall, a rear wall, a left side wall and a right side wall. Each of the opposite left and right side walls of the socket housing 31 is formed with an engagement opening 311, while a lower portion of one side wall of the socket housing 31 is formed with the ring-shape rotatable portion 33 projected outward therefrom. Furthermore, said one side wall is formed with a positioning hole 312. The insulating body 32 has an upper side formed with a pair of terminal slots 321, while each of two side walls of the insulating body 32 is formed with an engagement block 322 projected therefrom. The terminals 34 can be received in the terminal slots 321, and lower ends of the terminals 34 can pass through the terminal slots 133 of the socket plate 13 to be in contact with or separated from the elastic terminals 23 of the first conductive frame 21 or the second conductive frame 22. The engagement block 322 can be engaged in the engagement opening 311, so that the insulating body 32 can be engaged and positioned in the socket housing 31. The rotatable portion 33 is pivotally located within the rotation hole 50, so that the socket housing 31 can be rotated within a limited range of angles.

Figure 4:
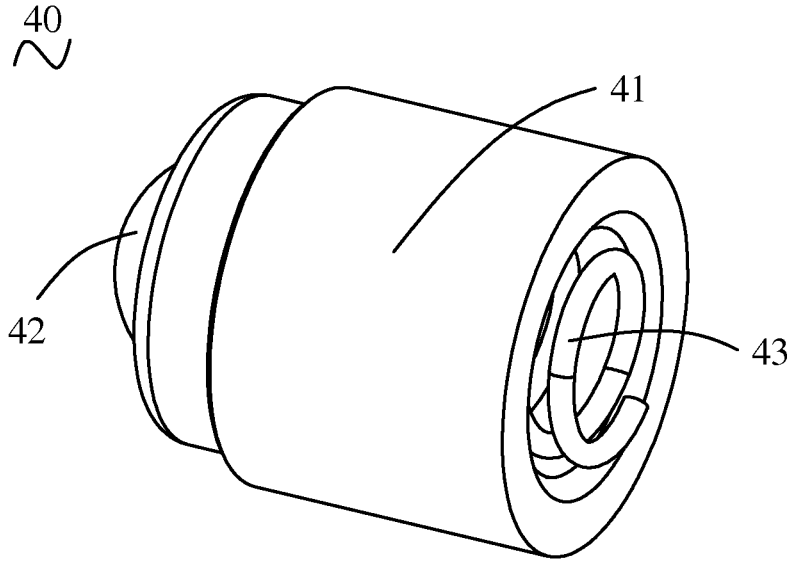
FIG. 4 is a perspective view of a positioning member of the power socket device having the rotation-operated switch function, as shown in FIG. 1.

Referring to FIGS. 2 and 4, the positioning member 40 has a hollow post 41, a ball 42 and an elastic element 43. One end of the positioning member 40 is mounted in the upper housing 11, and the other end thereof passes through the positioning hole 112. The ball 42 is installed in the end of the hollow post 41 close to the positioning hole 112, wherein a portion of the ball 42 is slidably displaced into the positioning hole 112 and projected out thereof into the recess 111, so that the positioning member 40 can be selectively engaged in the positioning hole 112 by use of the ball 42. The elastic element 43 is received in the hollow post 41, against the ball 42, and can be deformed elastically.

Figure 6:
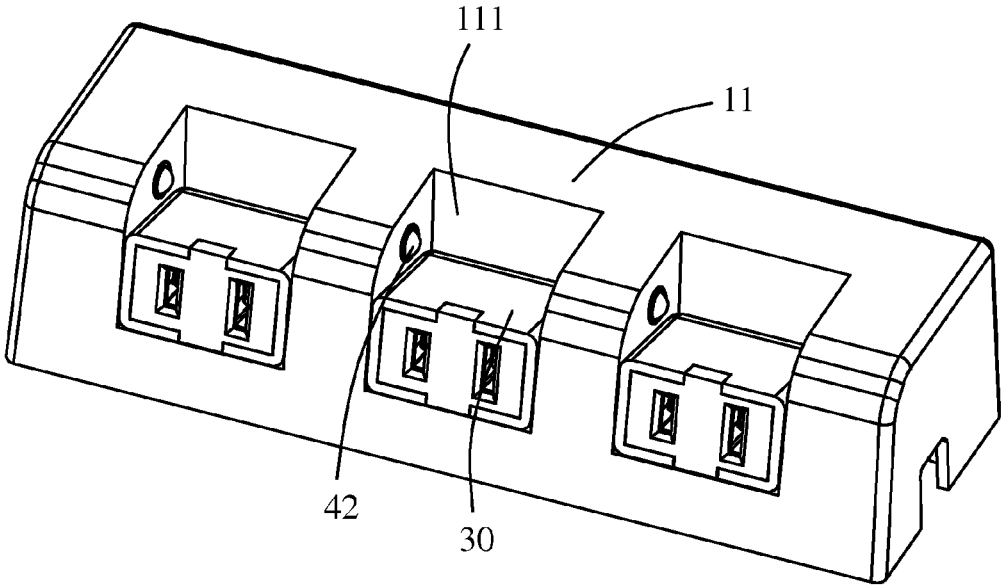
FIG. 6 is an operational view of the power socket device having the rotation-operated switch function after working, as shown in FIG. 1.

Referring to FIGS. 1 and 6, for the power socket device 100 of the present invention to be workable, the socket unit 30 is rotated until the terminal slots 321 of the insulating body 32 face upward. In the meantime, the ball 42 is partially engaged into the positioning hole 312 to hold the socket unit 30. Thus, the lower ends of the terminals 34 can pass through the terminal slots 133 to be in contact with the elastic terminals 23 of the first conductive frame 21 and the second conductive frame 22. When a plug of an external device (not-shown) is plugged into the socket unit 30, terminals of the plug can be in electrical contact with upper ends of the terminals 34. When the plug finishes working, it only needs to rotate the socket unit 30 by rotating the plug, and during such process the ball 42 will be gradually withdrawn from the positioning hole 312 (as shown in FIG. 6) and then shift toward the inside of the hollow post 41 to compress the elastic element 43. The socket unit 30 continues to rotate until the ball 42 is completely separated from the socket housing 31. Thus, the elastic element 43 is released, and the ball 42 will be biased to project outward. At this time, the terminal slots 321 of the insulating body 32 face forward, i.e. in the horizontal direction, and the lower ends of the terminals 34 are rotated to stretch out of the terminal slots 133 in the lower wall and into the terminal slots 133 in the rear wall of the socket plate 13. Thus, the lower ends of the terminals 34 are separated from the elastic terminals 23 of the first conductive frame 21 and the second conductive frame 22, so as to stop supplying electric power to the socket unit 30 and the plug of the external device.

As described above, the power socket device 100 of the present invention has a rotation-operated switch function, so that each of the socket units 30 can be rotated to switch on or off without unplugging the power socket device 100 or the external device, so that the operation of the power socket device 100 is relatively simple and labor-saving.

The present invention has been described with a preferred embodiment thereof and it is understood that many changes and modifications to the described embodiment can be carried out without departing from the scope and the spirit of the invention that is intended to be limited only by the appended claims.

What is claimed is:

1. A power socket device having a rotation-operated switch function, comprising:

a housing formed with a plurality of recesses on a top thereof, each of which is installed with a socket plate comprising a rear wall and a lower wall having a pair of terminal slots extending to the rear wall;

a first conductive frame and a second conductive frame, both of which are mounted in the housing; and a plurality of socket units, each of which is rotatably installed in one of the recesses and corresponding to the socket plate, wherein the socket unit has a socket housing, an insulating body installed in the socket housing and a pair of terminals installed in the insulating body, wherein lower ends of the terminals stretch into the terminals slots of the lower wall to be in contact with the first and second conductive frames, alternatively, the pair of terminals are rotated by rotation of the socket unit, so as to make the lower ends thereof stretch out of the terminal slots of the lower wall and into the terminal slots in the rear wall to be separated from the first and second conductive frames.

2. The power socket device according to claim 1, wherein one side wall of each of the recesses is formed with a positioning hole and an upper indentation, each of the socket plate is formed with a lower indentation, wherein the lower indentation and the corresponding upper indentation meet together to construct a rotation hole, the housing is provided with a positioning member which has a hollow post, a ball and an elastic element, wherein the ball is installed in one end of the hollow post close to the positioning hole, and a portion of the ball is slidably displaced into the positioning hole, so that the positioning member is selectively engaged in the positioning hole by the ball.

3. The power socket device according to claim 1, wherein each of the socket plates further has two side walls; the rear wall, the lower wall and the two side walls define a receiving space, and a lower portion of the socket housing is rotatably received in the receiving space.

4. The power socket device according to claim 1, wherein a rear wall of each of the recesses is formed with a pair of engagement holes, while the socket plate is correspondingly formed with a pair of positioning rods, wherein a distal end of each of the positioning rods is positioned in one of the engagement holes of the housing, so that the socket plate is mounted in the housing.

5. The power socket device according to claim 1, wherein each of the opposite left and right side walls of the socket housing is formed with an engagement opening, the insulating body is formed with a pair of terminal slots, while each of the two side walls of the insulating body is formed with an engagement block projected therefrom, wherein the pair of the terminals are received in the terminal slots, and the engagement blocks are engaged in the engagement openings respectively, so that the insulating body is engaged and positioned in the socket housing.

* * * * *